United States Patent [19]

Werres

[11] 3,979,898

[45] Sept. 14, 1976

[54] HANDLESS TIMEPIECE

[76] Inventor: Gunter Werres, In der Krumme 16, 6101 Weiterstadt, Germany

[22] Filed: May 14, 1975

[21] Appl. No.: 577,301

[52] U.S. Cl. ..... 58/2; 58/125 R; 58/125 C

[51] Int. Cl.[2] ..... G04B 45/00

[58] Field of Search ..... 58/125 R, 125 C, 126 R, 58/126 E, 2, 6 R, 6 A; 235/71 R, 71 A

[56] References Cited

UNITED STATES PATENTS

| | | | |
|---|---|---|---|
| 2,072,457 | 3/1937 | Larrabee | 58/125 C |
| 2,527,776 | 10/1950 | Taaffe | 235/71 A |
| 2,790,300 | 4/1957 | Lux | 58/6 A |
| 2,930,183 | 3/1960 | Nussle | 58/125 C |
| 2,952,967 | 9/1960 | Nussle | 58/125 C |
| 3,024,590 | 3/1962 | Wynne | 58/2 |
| 3,353,347 | 11/1967 | Gates et al. | 58/6 R |
| 3,603,073 | 9/1971 | Terada et al. | 58/6 R |
| 3,712,050 | 1/1973 | Kawada | 58/125 C |

*Primary Examiner*—Ulysses Weldon
*Attorney, Agent, or Firm*—Marvin Feldman

[57] ABSTRACT

A handless timepiece such as a clock or watch having a time indicator mounted on a driven belt of finite length driven by two rolls and wherein the time symbols are arranged in a preset sequence of the belt, and are caused to pass between these rolls in front of an indicator window, and wherein the belt drive is designed so that the belt is alternatively taken up from one roll to the next. The time symbol sequence on the minute belt is "00 59 01 58 02 57 03 . . . 33 27 32 28 31 29 30" and the time symbol sequence on the hour belt is "0 23 1 22 2 21 3 . . . 15 9 14 10 13 11 12", and wherein every second symbol appears in the indicator window. The present handless clock or watch avoids rewind of the belt and the concomitant lost time ocasioned by such rewind.

10 Claims, 3 Drawing Figures

HANDLESS TIMEPIECE

The invention relates to a handless clock or watch having a time indicator mounted on a finite driven belt, in the form of symbols arranged on the belt in preset sequence; the belt being wound on two rolls and caused to pass between these rolls in front of an indicator window of the clock or watch, and the drive for the belt being designed in such a way that the belt is alternatively wound from one roll onto the other one, and being stopped whenever the symbol to be indicated at that given moment is situated behind the indicator window.

In the case of spring-wound watches, even those with an indication of time, such belt drives are known in the art for instance from the German Pat. application No. 1,123,599, laid open for public inspection. In the case of these known indicators, the indicator belts carrying the hours and minutes are unwound from and then taken up on respective conjugated rolls. In that case, the roller pairs are driven by a joint drive motor, by means of a remote control, in the one or the opposite direction. In view of the fact that one uses, in the case of this known arrangement, finite belts the length of which is defined by the desired number of indicator positions, it is not readily possible to manufacture a watch or clock with continuous indication of time in the known design of spring-wound watches. The problem resides in the fact that, for instance, the belt designed to indicate the minutes and bearing the digits "00" to "59" has to be completely rewound after one hour to allow the indication "00" to follow after the indication "59". However, the rewinding of the belt requires several seconds during which the watch does not provide an accurate indication of time in minutes. The same holds true for the indication of the hours.

Another belt-type indication for watches, known through the German Pat. application No. 1,673,679, laid open for public inspection, solves this problem in that the belt designed to indicate minutes bears the digits "01" to "59". The digit "00" that is missing in this case is situated on an additional belt which, at the moment in time of the change in hours, is moved in front of the indicator belt and which, in the course of the subsequent time increment is pulled out of the window aperture. Meanwhile, the indicator belt has been rewound and now allows the next subsequent digit "01" to appear in the window aperture. The change in date by the hour belt takes place in a manner similar to the change in time of the minute belt. The drawback of this known design of a belt watch is its considerable manufacturing cost for the purpose of drive and control of movement cycle required for the advance and the rewinding of the minute and hour belts and for the winding and rewinding of the cover belts.

These drawbacks are obviated by this invention. It is an object of the present invention to provide a handless watch of the type referred to above which solves the stated problems, occuring upon indicating of time symbols by a finite belt, with simple means, characterized in that the drive for the belt is designed in such a way that the belt, if necessary with the exception of the extremities of the belt, remains stationary at that moment and at that particular moment only when each second symbol appears behind the indicator window.

In the case of this design of the drive for the belt, it is possible that, for instance for the indication of the minutes on a belt, the digits "00" to "59" are arranged on the belt in the following sequence: "00 59 01 58 02 57 03 . . . 33 27 32 28 31 29 30".

In other words, there now appears at the indicator window every second symbol thereby obviating the disadvantageous rewinding of the belt as a whole at the end of the first cycle, without the indication of any symbols. Rather, at the end of the belt one now reverses, likewise, the direction of rotation with the symbols omitted during the first cycle being indicated by means of a corresponding design of the drive.

In order to achieve that end, the drive will stop at every second symbol. The belt, in a preferred embodiment, is made of electrically nonconductive material and is provided with perforations arranged in juxtaposition in two tracks, said perforations being arranged alternatively on the one or the other track and which are sensed via a counter-contact, by respectively one stop-contact. During each run of the belt, one of these stops-contacts is interpolated in the circuit of the particular drive motor thereby causing that only the corresponding "correct" symbol, that is to say, every second symbol, stops behind the indicator window because, only in that case, the stop-contact applies against its counter-contact and arrests the drive motor.

In each case, at the end of the belt, a switch is to be actuated which reverses the direction of drive of the motor. This switch can connect at the same time into the circuit of the drive motor the stop-contact controlling the respective direction of drive of the belt so that, upon actuation of this switch the direction of rotation is reversed and the respective appropriate stop-contact is connected.

At the same time, this contact can actuate another contact that causes the voltage pulse controlling the series-connected belt indication. In this manner of construction, one achieves, in a simple manner, that the respective series-connected belt indication receives an impulse only at that moment, thereby being actuated, if the extremity of the belt of the preceding series-connected belt indication has been attained.

Insofar as one resorts to the solution, simple with regard to its design, to have each belt indication drive by a separate motor which therefore drives in each direction of rotation the roll constituting the motor roll in a given case, one must see to it that the freewheel clutch of the respectively pulled roll is not being engaged, not even if its winding diameter is smaller than that of the pulling roll. In that respect, a solution is proposed in such a way as to provide at each roll a freewheel, including a locking element connected to a lever which applies under frictional contact against the stationary shaft of the respective roll and which, depending on the direction of rotation of the roll, keeps the locking element disengaged or causes it, respectively, to become engaged.

A pawl or a clamping element can be used as a locking element.

The invention is described in greater detail below with reference to an exemplified embodiment disclosing additional important characteristics.

IN THE DRAWINGS

Figure 1:
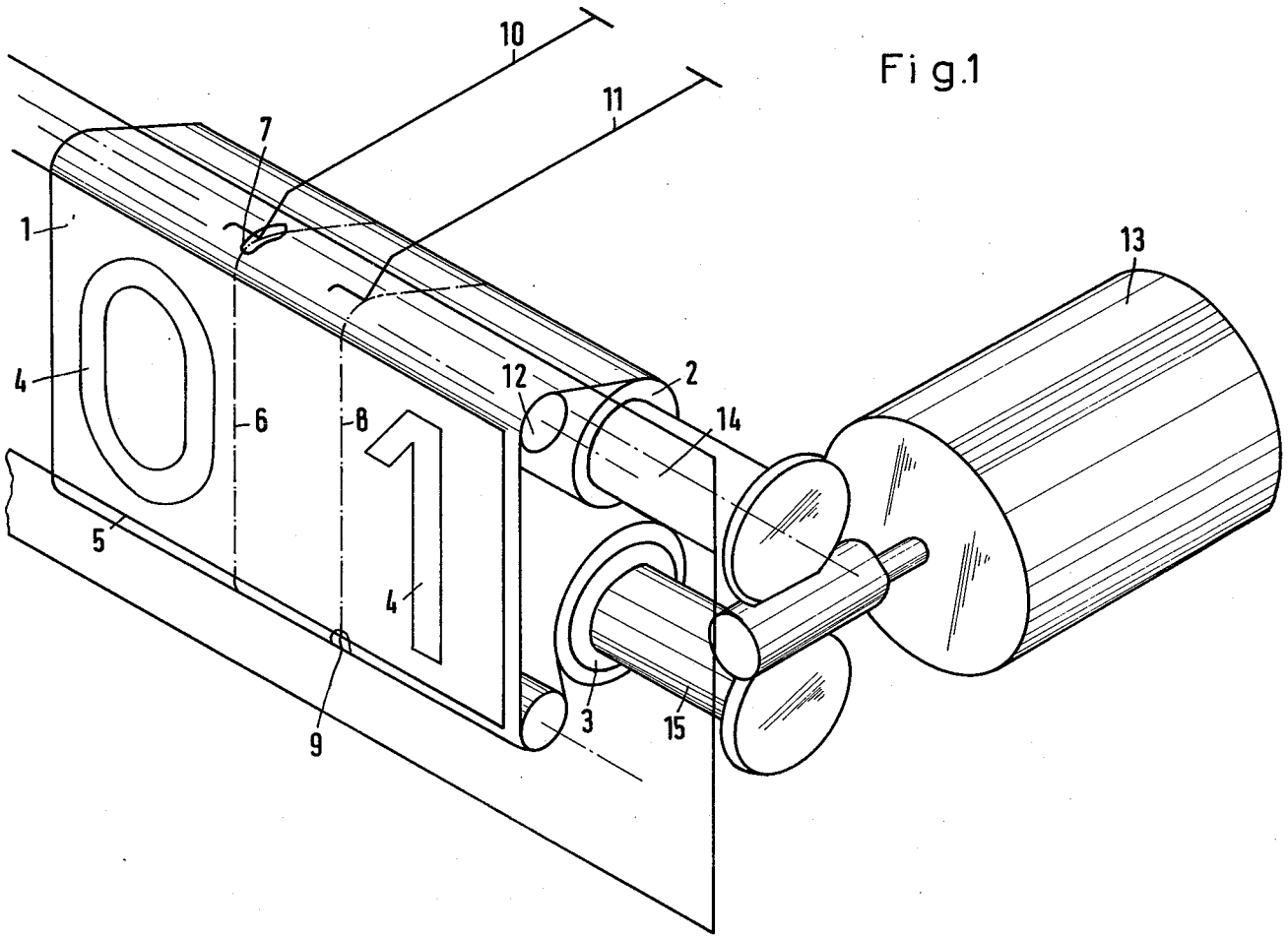
FIG. 1 represents a perspective view of the essential components for the minute indication of a handless watch in accordance with the invention.

The belt 1 is wound with its extremities on two rolls 2, 3 and is being conducted from one roll to the next one in such a way that the digit 4 to be indicated at every particular instant, appears inside a window aperture 5 of the watch. The change in digits occurs in that the belt is rewound, corresponding to the arrangement of the digits, from the one to the other roll. Thus, upon the change of digits, for instance from "00" to "01", the digit "59" is being skipped. In a similar manner, in the case of each additional change in digits, the "incorrect" digit is omitted. Following the skipping of the digit "30" the direction of advance of the belt is changed so that this digit is indicated as the first one in sequence. There are now being indicated, in sequence, the digits that have been omitted thus far, by skipping the previously indicated digits. Following the skipping of the digit "00", the direction of advance of the belt is once again reversed and the process described repeated.

Each digit "00" to "29" is arranged on the belt 1, consisting of an electrically nonconductive dielectric material, is assigned a perforation 7 on a track 6. On a parallel track 8 there are arranged the holes 9 pertaining to the digits 30 to 59. Two stop-contacts 10 and 11 are sensing in each case the respective perforated tracks 6, 8. They are arranged in such a way that they apply with spring action against the belt 1 and are being insulated from same by their counter-contact 12. The moment the digit 4 appears in the window aperture 5 of the watch, the hole 7 assigned to that digit comes to be situated beneath the respective stop-contact 10 thereby closing said contact.

An electric motor 13 actuates in each case the respective belt take-up roll, while the other roll is being taken along idly. As a result of a corresponding circuit, the motor runs only if, after every minute cycle is completed, it receives a starting pulse from any type of timer or else if the stop-contact 10 or 11 associated with the direction of travel of the belt is open.

Actuated by the starting pulse, the belt 1 starts running, the associated stop-contact 10 or 11 is opened so that the motor 13 will continue running even after the end of the starting pulse until the hole 7 or 9 assigned to the next digit to be indicated closes the stop-contact.

The reversal of the direction of travel of the belt occurs in such a way that the direction of the rotation of the motor 13 is reversed and the direction-dependent clutches 14, 15 disengage the hitherto driving roller and engage the hitherto driven roller. Another possibility to achieve the reversing is to bring it about by means of clutches 14, 15 in which case the direction of rotation of the motor 13 does not have to be reversed.

The actuating of the reversing cycle occurs by the belt 1 or by the roll 2 or 3 that is being pulled, depending on the direction of travel of the belt, as soon as there is no more belt on a given portion of the roll.

Simultaneously with the reversing of the directing of travel of the belt, a selector switch is actuated that closes the stop-contact 10 or 11 which, depending on the direction of travel of the belt, serves for the positioning of the "correct" digit(s).

The hour indication occurs in a manner similar to the minute indication. The hour digits from "0" to "23" appear on the hour belt in the following sequence: "0 23 1 22 2 21 3 . . . 15 9 14 10 13 11 12". As in the case of the minute indication, depending on the direction of travel of the belt, the "incorrect" digits are being skipped; likewise, depending on the skipping of the digits "12" or "0", the direction of travel of the belt is changed.

The starting pulse for the motor driving the hour belt is derived from the minute indication. By way of analogy, upon changeover from "23" to "0" of the hour indication there can occur a starting pulse relating to another series-connected belt indication, for instance a calender.

Figure 2:
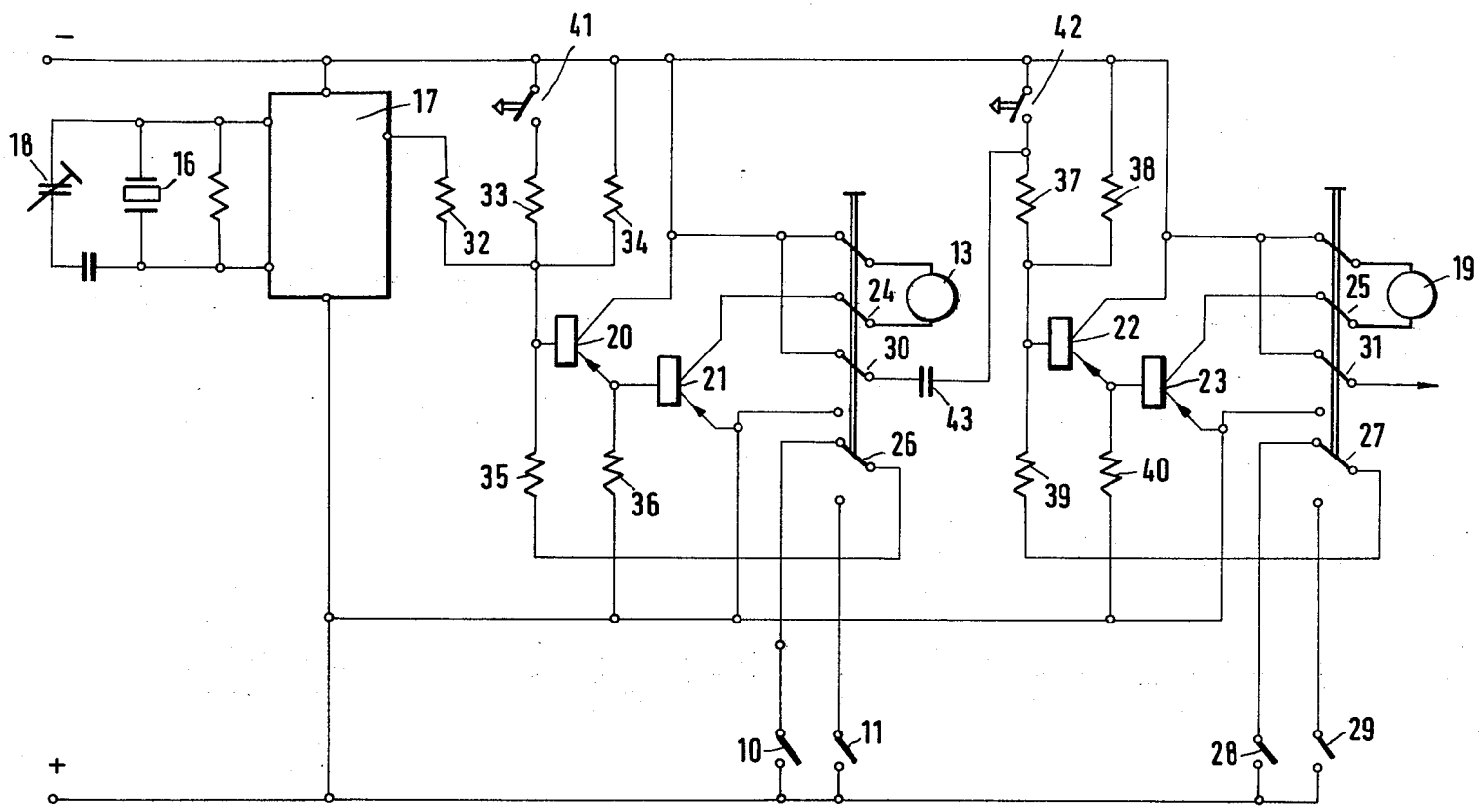
FIG. 2 represents a circuit of a handless watch in accordance with the invention.

The invention is described below in further detail with reference to the circuit illustrated in FIG. 2.

In the embodiment selected, a vibrator quartz 16 with series-connected frequency divider serves as a time basis for the watch drive. The energizing circuit for the quartz as well as the frequency divider increments are, in this arrangement, incorporated in an integrated circuit 17. The frequency of the quartz and the increment ratio are synchronized in such a way that, at the output of the divider chain, there is obtained one pulse per minute with defined pulse length. A trimmer 18 serves for the adjusting of the quartz to the assigned frequency.

The two motors 13 and 19 actuate via respective gears and two freewheel clutches the minute and hour belt, respectively, and are controlled by transistorized drivers 20–23 (i.e. 20, 21 or 22, 23) via direction reversing switches 24, 25, respectively. The latter are reversed at the end of the particular belt and, through polarity reversal of the respective drive motor 13, 19 being about the reversal of direction of the advance of the belt. Two additional switches are connected with the direction reversing switches 24, 25. One of them, 26, 27 selects the appropriate stop-contact 10 or 11 and 28 or 29 governing the respective direction of the belt, the other one, 30, 31, switches from positive to negative and vice-versa. This voltage pulse serves for actuating series-connected belt indications. The transistorized drivers 20-23 are series-connected with resistor networks 32-40. Said resistor networks are designed in such a way that the respective belt drive motor 13 or 19, is in operation when: there is present a negative actuating pulse resulting from the preceding gear shirt, or the pertinent stop-contact 10, 11 or 28, 29 is open, or the setting key 41, 42 for the time setting is actuated.

Once every minute the integrated circuit 17 generates a negative pulse at its output. As a result, the transistors 20, 21 are actuated, the drive motor 13 of the minute belt starts running and the stop-contact 10 selected by the direction reversing switch 26 being opened. The duration of the pulse of the integrated circuit 17 is in such a way that the negative pulse is terminated prior to the end of the belt setting period. The belt drive motor 13 continues running until the selected stop-contact 10 is closed, that is to say, the moment the next digit to be indicated is in its right position. Following passage of the last digit(s), depending on the direction of travel of the belt, the minute direction reversing switch 24 is actuated; simultaneously with said reversing cycle, the reversing switch 26 is actuated, thereby selecting the stop-contact 11 controlling the new direction of travel of the belt. Likewise, simultaneously with this reversing cycle, one controls, via the differentiating member (43 and 37), the driver circuit 22, 23 of the hour belt drive. In view of the fact that said drive reacts to negative pulses only, the advance of the hour indicator occurs only at one end of the minute belt, that is to say, following the completion of one hour.

The positioning and direction reversing of the hour belt occurs in a manner similar to the cycles described above.

Figure 3:
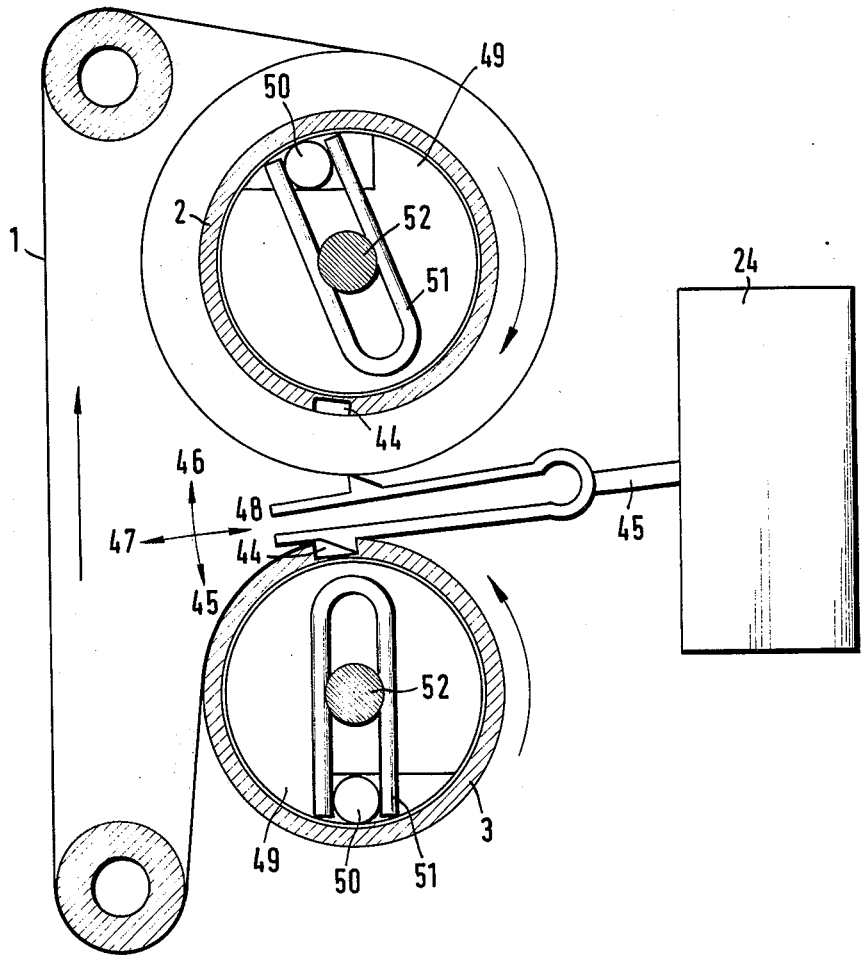
FIG. 3 represents a cross-sectional view with further details of the arrangement in accordance with FIG. 1.

As stated already, following passage of the last digit, depending on the direction of travel of the belt, there is being actuated a direction reversal switch 26 or 27. This switch is endowed with a click-break characteristic to prevent stoppage of the motor during the reversing cycle. In accordance with the exemplified embodiment illustrated in FIG. 3 the actuation proceeds in such a way that a notch 44 is being bared by the belt 1 in the respectively pulled roller 2 or 3 in such a way that a lever 45 applying against the roller with spring action drops into the notch 44 (direction of arrow 45 or 46) is carried along by same in the direction of the arrow 47 or 48 and actuates the reversing switch.

To prevent the freewheel clutch 49 of the respectively pulled roll to become engaged the moment its take-up diameter is smaller than that of the pulling roll, the locking element 50 or the pawl of each freewheel clutch is controlled by an actuating lever 51. Said lever is designed in such a way as to apply with slight clamping action against the shaft 52 of the roll 2 or 3. The locking element 50, as known with freewheel drives, is displaceably supported with tapering cross-section in a recess of the pertinent roll 2 or 3.

As many widely different embodiments of this invention may be made without departing from the spirit and scope thereof, it is to be understood that this invention is not limited to the specific embodiments thereof except as defined in the appended claims, and all changes which come within the meaning and range of equivalence are intended to be embraced herein.

What I claim is:

1. A handless timepiece comprising time indication means situated on at least one finite, driven belt, said time indication means comprising symbols arranged on said belt in a preset sequence and in which the belt is wound up on two rolls and said symbols caused to pass between said rolls at an indicator window of the timepiece, and the belt drive comprising a motor driving the belt by said rollers so that the belt is alternatively taken up from one roll to the other one and remains stationary whenever the particular symbol to be indicated is situated behind the indicator window, further characterized in that the belt controlled by one of two stop-contacts stops and remains stationary only the moment each second symbol of said symbols appears behind the indicator window characterized in that a switch means is actuated at the respective end of the belt for reversing the direction of rotation of said drive motor to drive the belt, further characterized in that control pulses are generated by a vibrator quartz having a series-connected frequency divider, said frequency divider transmits said pulses via a transistorized driver stage to said switch means for the direction of rotation of said drive motor, said driver stage being connected to a selector switch within said switch means connecting in each give direction of rotation one of said two stop-contacts to the driver stage to control the drive motor.

2. The timepiece of claim 1, characterized in that the belt comprises electrically nonconductive dielectric material and has two tracks with rows of juxtapositioned holes arranged alternatively on the one and the other track and which are being detected via a counter-contact by respectively one stop-contact.

3. The timepiece according to claim 2, further characterized in that the belt drive stops the moment a stop-contact applies against the cooperating counter-contact.

4. The timepiece of claim 1, further characterized in that there is provided at each roll, a freewheel having a locking element connected with a lever fitted with friction contact against the shaft of the respective roll.

5. The timepiece of claim 1, characterized in that said reversing switch means is connected to another series-connected transistorized drive stage, said another series-connected transistorized drive stage being connected to a second reversing switch means for controlling another driven belt by a second drive means depending on the second reversing position, with the positive or the negative voltage of the voltage source.

6. The timepiece of claim 5, further characterized in that the control input of the driver stage is connected with the voltage source via a deliberately actuated time setting key.

7. The timepiece of claim 1, further comprising means to provide control pulses to transistorized drive means to actuate said drive motor, each successive time frame.

8. The timepiece of claim 1, wherein each control pulse is intermittent and of a duration less than the belt stopping period for each successive time frame.

9. The timepiece of claim 1, further comprising key means to drive said motor to a desired time for setting said timepiece.

10. A handless timepiece comprising a finite belt having minute time symbols thereon in the following preset sequence, "00 59 01 58 02 57 03 . . . 33 27 32 31 29 30", and means comprising a motor to drive said belt in one direction so that each second symbol sequentially appears in a time indicator window and means to reverse the direction of said belt drive upon completion of the last symbol, so that each second symbol in reverse sequence then appears in said time indicator window characterized in that said reverse means comprises a switch means which is actuated at the respective end of the belt for reversing the direction of rotation of said motor to drive the belt, further characterized in that control pulses are generated by a vibrator quartz having a series-connected frequency divider and said frequency divider transmits said pulses via a transistorized driver stage to said switch means for the direction of rotation of the drive motor, said driver stage being connected to a selector switch within said switch means connecting in each given direction of rotation one of two-stop contacts to the driver stage to control the drive motor.

* * * * *